US005127786A

United States Patent [19]

Cross

[11] Patent Number: 5,127,786

[45] Date of Patent: Jul. 7, 1992

[54] BINDER METHOD

[76] Inventor: Carroll N. Cross, 3202 Holiday Ave., Apopka, Fla. 32703

[21] Appl. No.: 680,082

[22] Filed: Apr. 3, 1991

[51] Int. Cl.[5] ..... B42C 7/00

[52] U.S. Cl. ..... 412/3; 412/17

[58] Field of Search ..... 412/3, 17; 281/29, 37, 281/36

[56] References Cited

U.S. PATENT DOCUMENTS

| | | | |
|---|---|---|---|
| 4,405,156 | 9/1983 | Carter et al. | 412/3 |
| 4,600,346 | 7/1986 | Podosek | 412/3 |
| 4,712,808 | 12/1987 | Beh-Forrest et al. | 412/3 X |
| 4,863,331 | 9/1989 | Torti | 412/17 |

*Primary Examiner*—Timothy V. Eley
*Assistant Examiner*—William Fridie, Jr.
*Attorney, Agent, or Firm*—William M. Hobby, III

[57] ABSTRACT

A method of making a reinforced book or binder cover of polymer or paper covered panels includes feeding a planar panel such as a paperboard panel into a plurality of cutters, then cutting parallel cuts through the panel with pairs of adjacent parallel cutters and stripping the panel portions between the parallel cuts with a stripping member to form a plurality of spaced panels. A polymer hinge strip is fed onto the planar panels over each stripped away portion and is adhered thereto during the stripping step to thereby hold the separated panels in a spaced relationship to each other to form a hinge between panel sections. A polymer covering is adhered over the paperboard and over the polymer hinge strip on one side thereof to form a cover having a flexible hinge between the spaced panel sections. A polymer or paper liner may be adhered to the other side of the hinged panels and the polymer cover and polymer hinge members may be sealed together at the hinge with thermal or electronic sealing to define the hinges.

12 Claims, 3 Drawing Sheets

BINDER METHOD

BACKGROUND OF THE INVENTION

The present invention relates to a method of making reinforced hinge covers for three ring binders and the like and especially to hinged covers having a polymer covered panel with polymer reinforced hinge portions Typical prior art patents can be seen in the Torti U.S. Pat. No. 4,863,331 for a method of making half-binding hard covers for books and a machine for the implementation thereof and in the Podosek U.S. Pat. No. 4,600,346 for a binder cover and method of manufacturing the same having a unitary web of thermal plastic sheet material wrapped about and easily bonded over the binder panels. The Carter et al. U.S. Pat. No. 4,405,156 shows the making of a reinforced hinge for a book cover using a reinforced member secured to the edges of the leafboard of the book cover. The Peterson et al. U.S. Pat. No. 2,758,631 shows an apparatus for making plastic covers in a conventional three ring binder method which simultaneously heats and seals similar plastic sheets with stiffeners therebetween.

The present invention, on the other hand, teaches a method for cutting parallel cuts in a stiffening panel and stripping the area between the cuts from a large stiffening panel while attaching a reinforcing polymer strip over the stripped away area of the panel to hold the panel sections in a predetermined spaced relationship to each other with a defined spacing for the hinge and then covering at least one side with a polymer sheeting and then sealing the polymer reinforcing and spacing member and the polymer cove along the hinge line to form a defined reinforced hinge for a book cover or three ring binder.

SUMMARY OF THE INVENTION

A method of making a reinforced hinged cover of polymer covered panel board includes feeding a planar panel into a plurality of cutters, then cutting parallel cuts through the board with pairs of adjacent parallel cutters and stripping the panel strip from the planar panel boards between the parallel cuts with a stripping member to form a plurality of spaced paperboard members. A polymer reinforcing hinge strip is fed onto the planar panel boards to cover each stripped away portion and is adhered thereto as each panel strip between the parallel cuts is stripped away to thereby cover each space having the panel stripped away so that the polymer hinge strips hold the panel sections in a spaced relationship to form a hinge therebetween. A polymer covering is adhered over the paperboard and over the polymer hinge strip on one side thereof to form a cover having a flexible hinge between the spaced panel sections. A polymer or paper liner may be adhered to the other side of the hinged panel and the polymer cover and polymer hinge members are sealed together at the hinge with thermal or electronic sealing to define the hinges.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
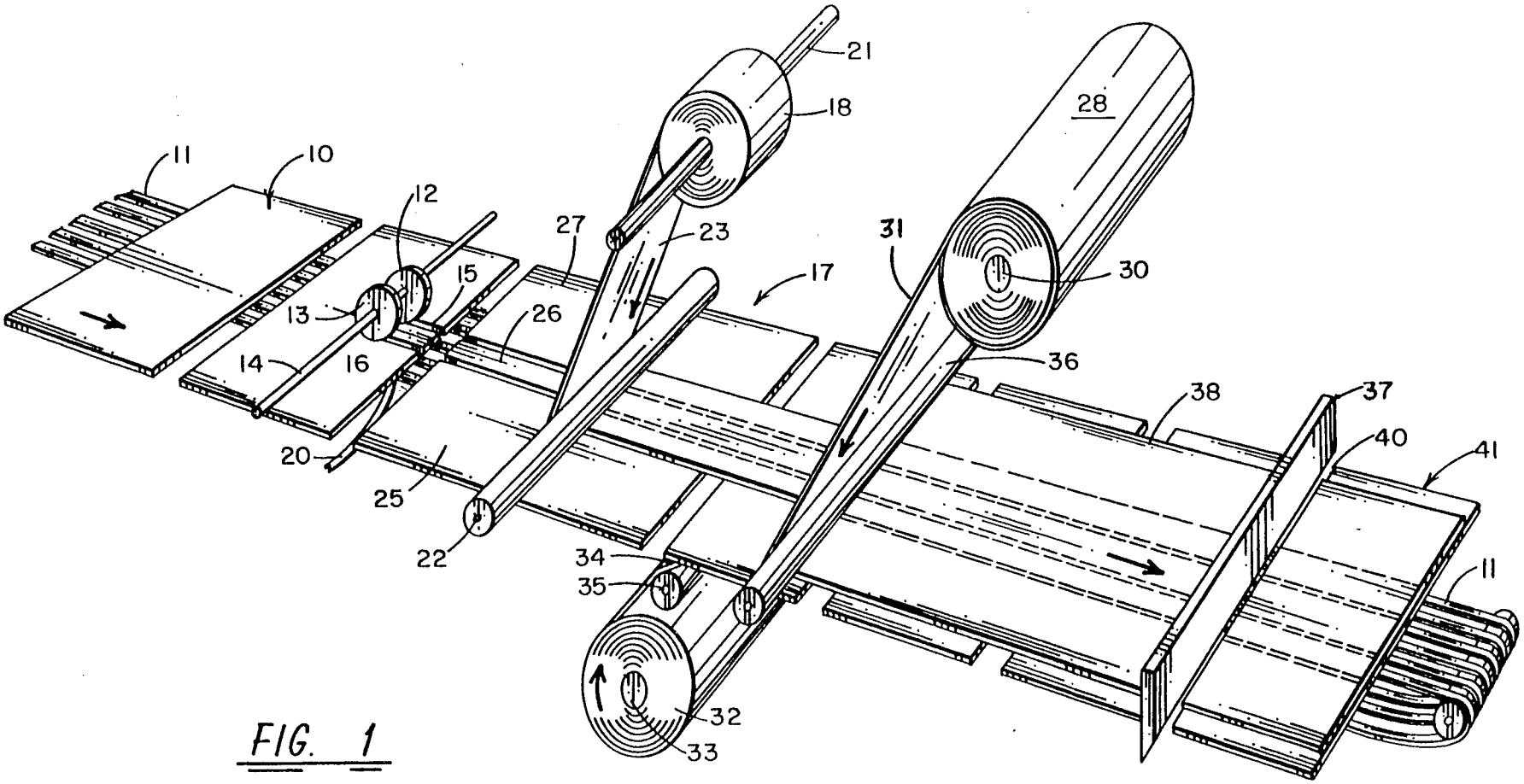
FIG. 1 is a perspective view of a portion of a hinged cover forming apparatus for the present method.

Referring to FIG. 1 of the drawings, a method in accordance with the present invention has a plurality of panels 10 which may be 0.050 to 0.110 inch paperboard panels and are fed on conveyor belt straps 11 past dual parallel cutters 12 and 13 which are rotated on a cutter shaft 14. The cutter 12 has two cutting blades cutting parallel cuts at a predetermined spacing to form hinge gaps 15. Similarly, the parallel cutters 13 cuts a parallel cut with spacing as shown at 16. The space between the parallel cuts 15 and 16 is immediately stripped from the board by a stripper 20 located underneath the panels 10 between belt straps 11 so that by the time the first board 10 is fed completely past the cutters 12 and 13 it has been cut into three panels with predetermined narrow strips stripped from the middle leaving a spacing 15 and 16. The panel 10 continues to the next station as shown with a panel 17 where a roll of polymer tape 18 is mounted on a spool shaft 21. The polymer tape 18 may be vinyl tape being continuously fed under a pressure roller 22 directly covering the hinge spacings 15 & 16 with the tape from the roll 18. The polymer tape 23 from the roll 18 is adhesively attached to the panel 17 which has now been cut into three panels 25, 26, and 27 and covers both spacings 15 and 16. The tape 23 and 24 is attached just following the cutting and stripping by the cutters 12 and 13 to thereby hold the three panels 25, 26, and 27 together in an exact predetermined spaced relationship as cut and stripped by the dual cutters 12 and 13. The spacing 15 and 16 is exactly as required by the thickness of the board to provide a pair of hinges that will bend without interference between the two hinged panels. The strips 23 also provides a reinforcing polymer hinge strip.

As the panels continue into the next station, a large roll of polymer liner material 28 is fed from a spool shaft 30 to feed vinyl 31 or paper or another polymer as desired to cover the main portion of the panels 25, 26, and 27 over the reinforcing tape 23. The vinyl covering 23 may be adhesively attached to the panels 25, 26, and 27. Simultaneously, a bottom roll of liner paper or polymer 32 is used to line the underside of the panels 25, 26 and 27 by feeding a vinyl or paper or the like from the roll 32 rotating on the spool 33 to feed a continuous covering strip 34 beneath a feed roller 35 to adhesively attach the bottom liner from the roll 3 onto the bottom of panel sections 25, 26, and 27. A pressure and feed roller 36 presses the top liner material 31 directly onto the boards.

Thus, the panel 10 is fed through a series of stationary cutting and stripping stations for each panel, and attaches a reinforcing hinge tape to hold the spacing on the hinged panels which are then lined on the top and bottom with a polymer material, such as vinyl. The panels are fed from the lining station as a continuous strip where a guillotine cutter blade 37 is automatically actuated to cut the lining material at 38 between the spaced panel boards 10 and which cutter 37 can also be used to cut the panels transverse at 40 between the ends of the panel to form more than one three ring binder cover or book cover from each panel 10.

The three ring binder cover covering liners of the present invention would normally be a polymer material, such as a vinyl, as would the reinforcing tape 23. In addition, the vinyl cut panels 41 would then have their edge portions cut off and the vinyl thermally or electronically sealed along the elongated spacing 15 and 16. This marks the hinges on the outside of the lining material and by the use of the vinyl reinforcement spacing material 23, the sealing will seal the covering liner material 31 directly to the reinforcing strip 23 and to the underside liner material 34 so that all three layers are sealed together along the hinge strip through the spacing 15 and 16 of each panel to form a three ring binder or book cover with improved strength at the hinge and having the components sealed together.

Figure 2:
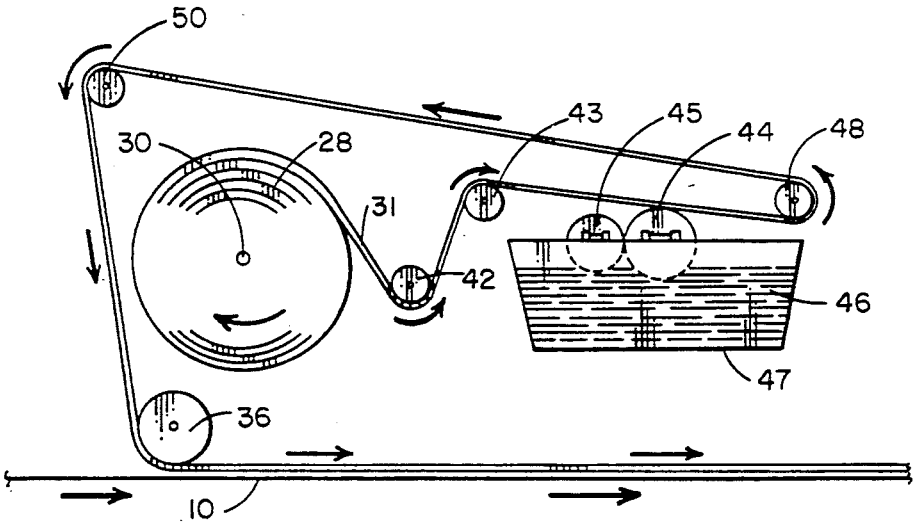
FIG. 2 is a side elevation of the top side feed roller and glue applicator.

FIG. 1 illustrates the feeding of the top and bottom liners without showing the use of the glue applicator while FIG. 2 illustrates the top side glue application for use with a roller 28. Thus, a top feed roll 28 of a vinyl liner material is fed from a shaft 30 to feed the vinyl lining material 31 past a first feed roller 42 and then over a second feed roller 43 and over a glue application roller 44. The glue application roller 44 has a second glue roller 45 rolling thereagainst and both rollers extend into adhesive 46 in a glue pot 47. The adhesive coated material 31 is then fed around the feed roller 48 with adhesive on the outside so as not to contact the roller 48 and again around the feed roller 40 and finally around the pressure roller 36 and onto the panels 10 being fed therethrough.

Similarly, the bottom roll of lining material, such as vinyl liner, is fed from the roll 32 riding on the shaft 33. The vinyl material 34 is fed past a feed roller 51 and over a adhesive applying roller 52 riding on a shaft 53 with a bottom portion thereof riding in the adhesive 54 in the glue pot 55. A second adhesive roller 56 rides against the roller 52 and smooths the adhesive. The adhesive coated liner 34 is then fed around a feed roller 57 and then around the pressure rollers 35, 58, and 59 to apply the bottom liner material to the bottom of the panels 10 being fed through the system.

The process thus includes the feeding of planar panels 10 such as paperboard panels, through a plurality of cutters 12 and 13, each of which is cutting two parallel cuts at a predetermined spacing so that the material between the two cuts can be stripped from the boards. The method includes stripping the material from between the parallel cuts, then feeding the reinforcing hinge tape 23 onto the cut panels to cover the strip spacing and adhering the reinforcing hinge tape thereto to hold the spacing of the panel sections while the top and bottom liners are fed over and adhered to the panel sections. The method includes cutting the panels with the guillotine cutter 37 and then the application of a thermal or electronic sealing to the outside of the lining material along the spaced areas 15 and 16 to define the hinges and to simultaneously attach vinyl linings to the reinforcing vinyl hinge tape.

Figure 4:
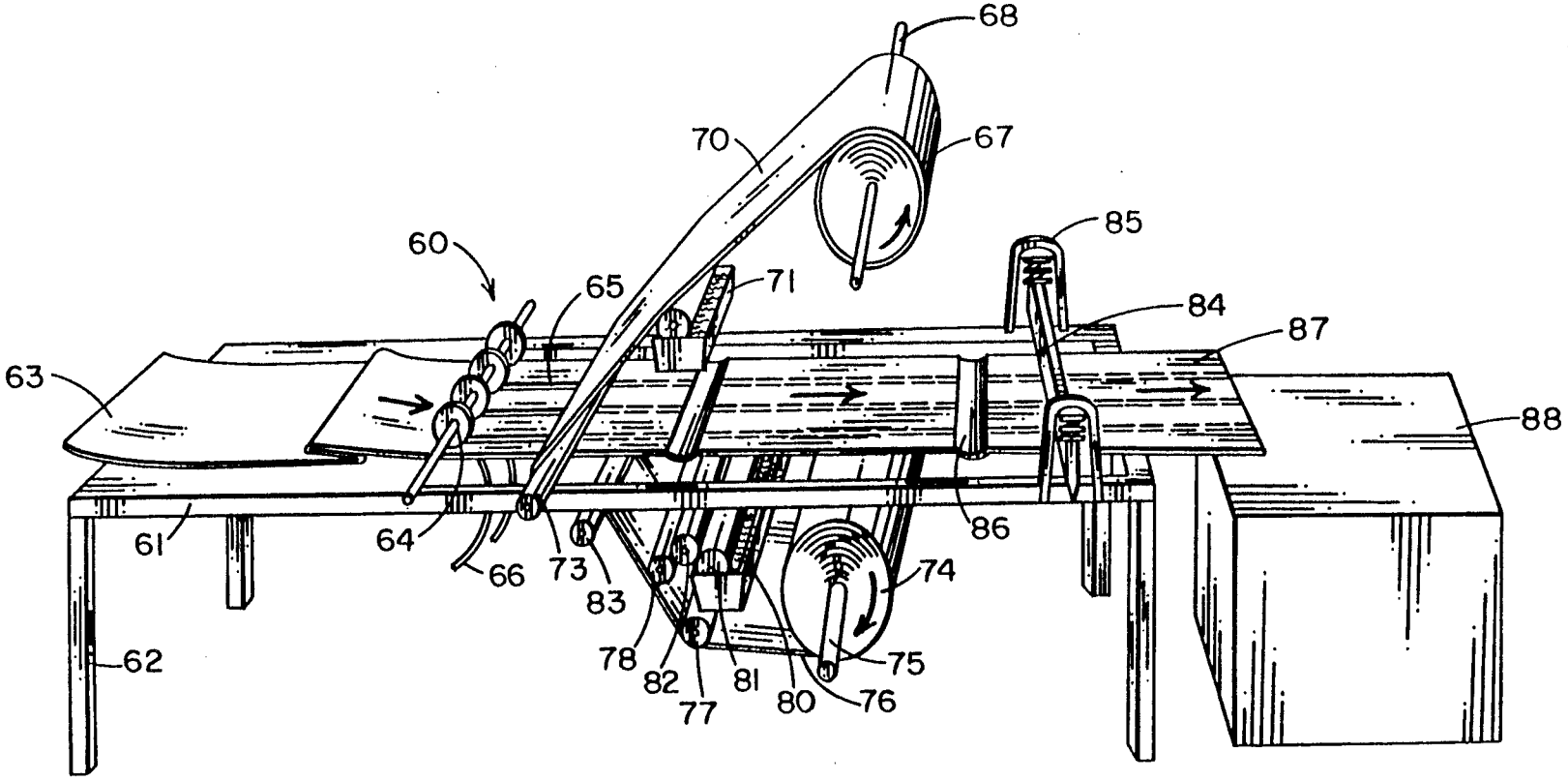
FIG. 4 is a perspective view of a second embodiment of a machine for making hinged panels.

Turning to FIG. 4, an alter embodiment of a method of making hinged covered panels is illustrated with the apparatus 60 having a table 61 supported by a plurality of legs 62. Panels 63 are fed through a plurality of cutters 64, each cutter being two cutters cutting parallel cuts 65 in the panels 63 having a predetermined spacing for use as a hinge. Simultaneously, the space between each two cuts from the cutter 16 has the strips 66 stripped away to form the spacing 65. An upper feed roll 67 riding on shaft 68 feeds a lining material 70, such as a vinyl or paper lining, past a glue pot 71 over a gluing roller 72 and around a pressure roller 73 onto the cut and stripped panel 63 to hold the spacing 65 between the plurality of cut spacings in the panel 63. Simultaneously, a lower feed roll 74 riding on a spool shaft 75 feeds lining material 76 past a feed roller 77 past an adhesive application roller 78 feeding adhesive from a glue pot 80 through adhesive rollers 81, 82 and around a pressure roller 83 onto the bottom of the panels 63. A guillotine cutter 84 is supported in cutter guides 85 and automatically cuts the panels lining material at 86 between the panels. It may also be used to cut the panels into two or more panels for forming two or more covers if desired. Top and bottom line panels having a plurality of hinged stripped areas formed therein and are fed to a stack of panels 88. The panels can then be fed to another machine for cutting into smaller lined panels and for application of a sealing iron to seal the top liner 70 and the bottom liner 76 together through the hinged spacing areas 65.

Figure 3:
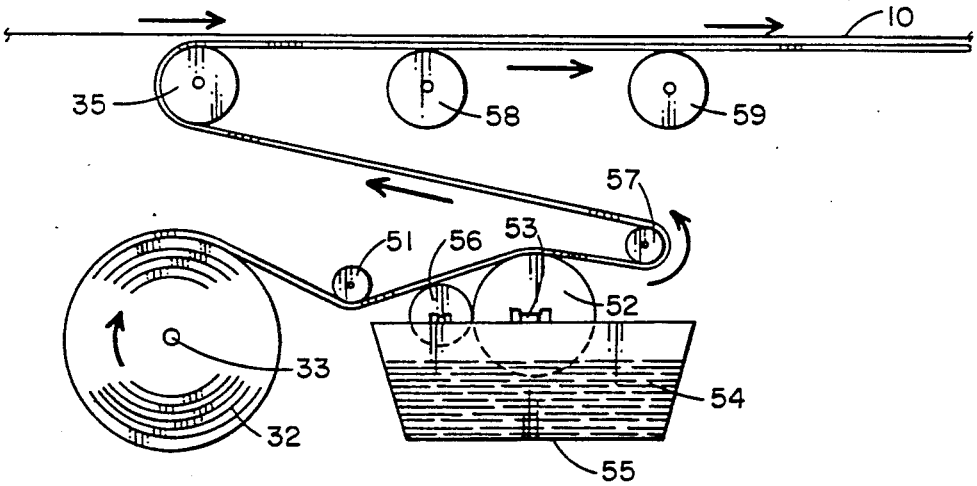
FIG. 3 is a side elevation of the underside feed roller and glue applicator.

This process along with the process as illustrated in FIGS. 1-3 allows the continuous making of hinged binder or book panels with precise alignment of a plurality of panels with a predetermined spacing for the hinge spaces in accordance with the board thickness without having special means for aligning a plurality of panels. FIGS. 1-3 has a provision for a reinforced hinge which can advantageously be attached from the outside across the hinge area so that three layers of vinyl are attached together at the hinges to provide a greatly reinforced hinge area. The process may also provide for sealing the covering material around the edges of the panels to finish the binder. However, the present invention is not to be considered limited to the forms shown which are to be considered illustrative rather than restrictive.

I claim:

1. A method of making a reinforced hinged panel cover for a binder or the like comprising the steps of:

feeding a planar panel into a plurality of cutters;

cutting parallel cuts through said panel with two adjacent parallel cutters to form a plurality of panel sections;

stripping a strip of material from said planar panel between said parallel cuts to thereby form a pair of spaced panel sections;

feeding a strip of hinge tape from a roll onto said panel over the stripped away portion to thereby cover the space between cut panel sections;

adhering said hinge tape to said panel sections over said stripped away portion to thereby hold said panel sections in a spaced relationship to each other; and covering said panel sections and hinge tape on one side thereof with a polymer liner and adhering said polymer liner over said paperboard to form a cover having a hinge between said panel sections whereby a hinged cover having spaced panel sections has a reinforced hinged area.

2. A method of making a reinforced hinged panel cover in accordance with claim 1 including the step of sealing said hinge tape to said polymer cover liner.

3. A method of making a reinforced hinged panel cover in accordance with claim 2 including the step of sealing a polymer hinge tape to said polymer cover liner.

4. A method of making a reinforced hinged panel cover in accordance with claim 3 including the step of cutting parallel cuts through said panel with two sets of two adjacent parallel cutters and stripping a pair of panel strips from said planar panel between each of said parallel cuts to thereby form three spaced panel sections.

5. A method of making a reinforced hinged panel cover in accordance with claim 4 including the step of feeding polymer hinge tape from a roll onto said planar panel sections over both said stripped away portions to said panels during the stripping away of panel strips to thereby cover the spaces between panel sections; and adhering each said polymer hinge tape to said panels across said stripped away portions to thereby hold said panel sections into three spaced sections in spaced relationship to each other.

6. A method of making a reinforced hinged panel cover in accordance with claim 5 including the step of covering said panel sections and polymer hinge tape on one side thereof with a polymer liner and adhering said polymer liner over said panel sections to form a cover having a pair of hinges between said spaced panel sections whereby a hinged cover having spaced panel sections has at least two polymer coverings forming each hinge of the hinged cover.

7. A method of making a reinforced hinged panel cover in accordance with claim 6 including the step of covering said three panel sections on a second side thereof with a polymer liner and adhering said polymer liner over said three panel sections to form three panel sections hinged together.

8. A method of making a reinforced hinged panel cover in accordance with claim 6 including the step of covering said panel sections on a second side thereof with a paper liner and adhering said paper liner over said paperboard one side thereof to form a paper lining on the inside of said hinged cover.

9. A method of making a reinforced hinged panel cover in accordance with claim 7 including the step of cutting said covered panel sections across said hinges to form a plurality of hinged covers.

10. A method of making a reinforced hinged panel cover for a binder or the like comprising the steps of:

feeding a planar panel into a plurality of cutters;

cutting parallel cuts through said panel with two adjacent parallel cutters to form a plurality of panel sections;

stripping a strip of material from said planar panel between said parallel cuts to thereby form a pair of spaced panel sections;

feeding a strip of planar polymer material onto said panel over the stripped away portion to thereby cover the space between cut panel sections;

adhering said strip of planar polymer material over said panel sections over said stripped away portion to thereby hold said panel sections in a spaced relationship to each other; and covering said panel sections and strip of planar polymer material on one side thereof with a polymer liner; and adhering said polymer liner over said paperboard to form a cover having a hinge between said panel sections whereby a hinged cover having spaced panel sections has a reinforced hinged area.

11. A method of making a reinforced hinged panel cover in accordance with claim 10 including the step of sealing said planar polymer material to said covering polymer liner.

12. A method of making a reinforced hinged panel cover in accordance with claim 11 including the step of covering said panel sections and planar polymer member on both sides thereof with a polymer liner and to form a cover having a hinge between said spaced panel sections whereby a hinged cover has spaced panel sections having at least three polymer layers forming the hinge of the hinged cover.

* * * * *